US006688594B2

(12) United States Patent
Dünninger, deceased et al.

(10) Patent No.: US 6,688,594 B2
(45) Date of Patent: Feb. 10, 2004

(54) SUCTION ROLL

(75) Inventors: Reinhold Dünninger, deceased, late of Würzburg (DE), by Brigitte Dünninger, legal heir; Manfred Georg Stöhr, Güntersleben (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 2 days.

(21) Appl. No.: 10/130,298

(22) PCT Filed: Dec. 1, 2000

(86) PCT No.: PCT/DE00/04294

§ 371 (c)(1),
(2), (4) Date: Aug. 15, 2002

(87) PCT Pub. No.: WO01/40091

PCT Pub. Date: Jun. 7, 2001

(65) Prior Publication Data

US 2003/0047866 A1 Mar. 13, 2003

(30) Foreign Application Priority Data

Dec. 2, 1999 (DE) ..... 199 58 134

(51) Int. Cl.[7] ..... B65H 5/02
(52) U.S. Cl. ..... 271/275; 271/243; 271/276
(58) Field of Search ..... 271/275, 243, 271/276; B65H 5/02

(56) References Cited

U.S. PATENT DOCUMENTS

| | | | | |
|---|---|---|---|---|
| 2,944,812 A | | 7/1960 | Winkler et al. | |
| 3,845,951 A | * | 11/1974 | Hamaker | 271/243 |
| 3,942,787 A | * | 3/1976 | Bolza-Schunemann | 271/237 |
| 4,607,935 A | * | 8/1986 | Kindt et al. | 399/303 |
| 4,696,465 A | * | 9/1987 | Willi | 271/237 |
| 5,836,581 A | | 11/1998 | Vernackt | |
| 5,938,193 A | | 8/1999 | Bluemle et al. | |
| 5,971,393 A | | 10/1999 | Vernackt | |

FOREIGN PATENT DOCUMENTS

| | | |
|---|---|---|
| DE | DT 23 30 484 A1 | 1/1975 |
| DE | 23 30 484 C3 | 8/1980 |
| DE | 33 11 196 C2 | 7/1987 |
| EP | 0 795 503 A2 | 3/1997 |
| EP | 0 846 638 A2 | 6/1998 |

* cited by examiner

*Primary Examiner*—Donald P. Walsh
*Assistant Examiner*—Kenneth W. Bower
(74) *Attorney, Agent, or Firm*—Jones, Tullar & Cooper, PC

(57) ABSTRACT

A suction roller is used to transport aligned sheets in a sheet processing machine. A portion of the circumferential surface of the roller has suction ports. A drive motor is provided for the suction roller and can drive the suction roller at varying speeds. Sheets are transported by the suction roller to a subsequent transport system.

5 Claims, 1 Drawing Sheet

SUCTION ROLL

FIELD OF THE INVENTION

The present invention is directed to a suction roller. The suction roller is used for conveying sheets in a sheet processing machine.

BACKGROUND OF THE INVENTION

A sheet feeding device is known from DE 33 11 196 C2, in which an alignment cylinder has a suction drawing strip in the vicinity of its front lay marks. The suction drawing strip is used for aligning the lateral edges of sheets. In the course of the transfer of the sheets to a following drum, the start of each sheet is held by grippers, and the front lay marks border the sheet.

DE 23 30 484 C3 describes a suction roller with individual suction rings.

EP 0 846 638 A2 describes a device for mounting a sheet on a suction drum with detents.

SUMMARY OF THE INVENTION

The object of the present invention is directed to creating a suction roller.

In accordance with the present invention, this object is attained by providing a suction roller for conveying sheets in a sheet processing machine. The suction roller can be driven at varying circumferential speeds. A portion of its exterior surface projects through a slit provided in a guide element. The suction roller has front lay marks on its circumference and has its own drive motor.

The advantages which can be achieved by the present invention reside, in particular, in that printed sheets can be passed, with their front edges aligned, to a further processing station by use of a single roller. In this case, every sheet is bent only slightly, during its transport to the further processing station by use of a suction roller. During the transfer to the next conveying means, the start of the sheet is free of holding elements or detents.

Furthermore, a great amount of flexibility of the chain of movements of the suction roller is possible because of the suction roller having its own electric motor.

BRIEF DESCRIPTION OF THE DRAWINGS

A preferred embodiment of the present invention is represented in the drawings and will be described in greater detail in what follows. Shown are in.

DESCRIPTION OF THE PREFERRED EMBODIMENT

Figure 1:
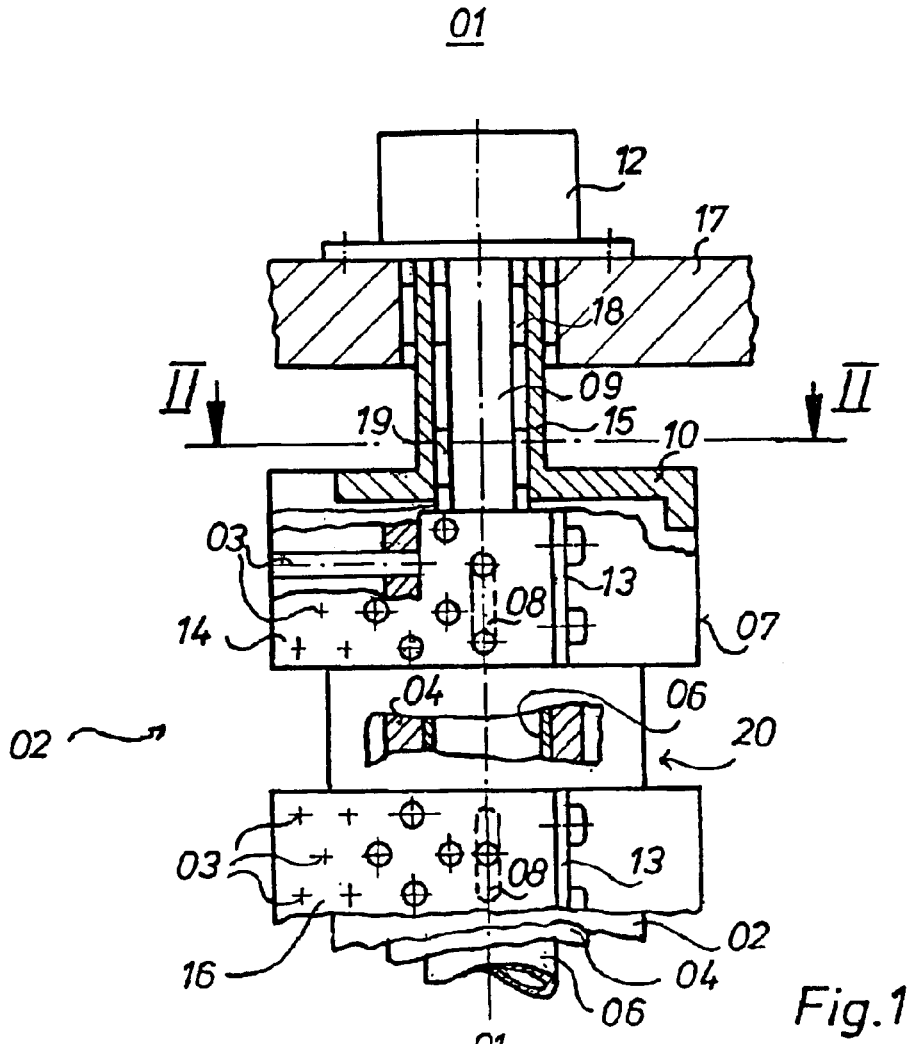
FIG. 1, a view from above on the right end of a suction roller with a drive mechanism in accordance with the present invention; and in FIG. 2, a section taken along line II—II in FIG. 1.

A suction roller 01 consists, for example, of a hollow cylinder 02 with bores 03 extending in the radial direction, as shown in FIG. 1. The hollow cylinder 02 is rotatably seated on a support tube 06, which has a first end that is fixed in lateral frames and whose exterior is provided with white metal 04. The radially extending bores 03 extend approximately over half, i.e. 150° to 210°, in particular 180° to 210°, of the outer surface, or the circumferential line or surface 07 of the suction roller 01.

The support tube 06, as well as the white metal 04, are provided with air supply slits 08 which terminate on their upper, i.e. close to the sheet, side, so that suction air supplied through the first end of the support tube 06, seated fixed in the lateral frames, can reach the respective bores 03 of the hollow cylinder 02. Regarding the suction effect, there exists an effective portion of the exterior surface 07 of the suction roller 01, approximately 20 to 30 degrees of arc.

On its second end, the support tube 06 is provided with a journal 09, on which an engagement sleeve 15, seated on a roller, is rotatably arranged and which engagement sleeve 15 is connected, fixed against relative rotation, with the rotatable hollow cylinder 02 by use of a crimped engagement arm 10 oriented in the radial direction. The engagement sleeve 15 is seated by rolling bearings 18, 19 of the journal 09, or on a lateral frame 17 in rolling bearings 18, 19. A drive motor 12, for example a step motor, or an angular position-controlled electric motor; i.e. an individual drive, for generating an uneven or variable speed of the hollow cylinder 02 in the circumferential direction, is flanged to the side of the lateral frame 17 facing away from the roller and is connected with the engagement sleeve 15.

Figure 2:
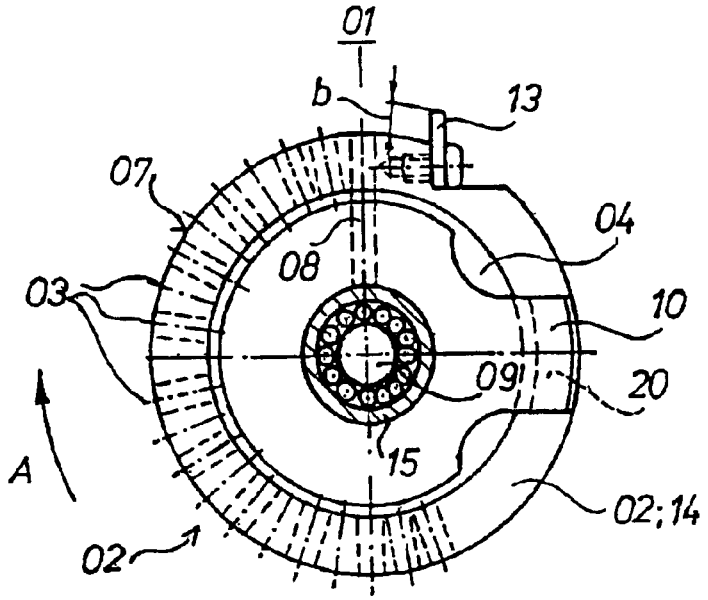

Viewed in the clockwise direction of rotation A of the suction roller 1, as seen in FIG. 2, at the start of its cut-in bores 03, the hollow cylinder 02 has front lay marks 13 which are arranged next to each other in the direction toward the suction roller 01, and which protrude by an amount b, for example three to five millimeters, past the circumferential surface or line 07 of the hollow cylinder.

In accordance with a preferred embodiment, the hollow cylinder 02 has suction rings 14, 16, which are provided with bores 03 and which are located, spaced apart in the axial direction, next to each other on the hollow cylinder 02. The suction rings 14, 16 are spaced apart by respective annular grooves 20 cut into the hollow cylinder 02. It is also possible to provide additional suction rings, which are not specifically represented. Each suction ring 14, 16 also has bores 03 extending over half the circumferential surface or line 07, which bores 03 also penetrate the hollow cylinder 02.

Viewed in a conveying direction of a sheet, the suction roller 01 is arranged at the discharge end of a feed table, for example, in such a way that its exterior surface or circumferential line 07 is located slightly above the table top.

If—as represented—the suction roller 01 has suction rings 14, 16, a separate slit is provided in the feeding table for each of the suction rings 14, 16.

Viewed in the conveying direction and after the feeding table, a further processing station, for example a conveying roller or a printing cylinder, is arranged, which can take over the sheet, for example by means of gripper systems.

The mode of functioning of the suction roller 01 of the present invention is as follows:

A sheet, whose lateral edges have already been aligned, is conveyed by generally known means in the conveying direction on the feeding table up to the front lay marks 13 of the idle suction roller 01 whose circumferential speed now equals zero. The hollow cylinder 02 is accelerated from zero to 0.7 m/s, for example, by operation of the drive, which can be rotated at different numbers of rotation and which includes the motor 12, the engagement sleeve 15 and the engagement arm 10, so that on a straight acceleration path and a subsequent synchronized path, the sheet attains the circumferential speed of the printing cylinder of, for example 0.6 m/s, and is held fast on the printing cylinder by the provision of a gripper system at a preset gripper closing point. In the course of conveying a sheet, respectively at least one or several bores 03 of the rotating suction rings 14, 16 are connected with the air supply slit 08 of the support tube 06, so that a movement of the sheet in the conveying direction can take place. Thus, in the course of one rotation of the suction roller 01, the circumferential speed swings between zero and 1.3 to 2.5 times the circumferential speed of the printing cylinder.

The conveying speed of the sheet can be slightly, for example 10%, greater than the conveying speed of a following conveying means, for example a cylinder. This following conveying means also can have front lay marks, so that an alignment takes place again.

While a preferred embodiment of a suction roller in accordance with the present invention has been set forth fully and completely hereinabove, it will be apparent to one of skill in the art that a number of changes, for example in the printing press used with the suction roller, the type of sheet being printed and the like could be made without departing from the true spirit and scope of the present invention which is to be limited only by the following claims.

What is claimed is:

1. A suction roller useable to convey sheets in a sheet processing machine comprising:

a suction roller circumferential surface, said suction roller circumferential surface being sized to project through a slot in a feeding table of the sheet processing machine;

a plurality of front lay marks on said suction roller circumferential surface and projecting past said surface; and a drive motor for said suction roller, said drive motor being operable at varying circumferential speeds.

2. The suction roller of claim 1, further including means charging a portion of said suction roller circumferential surface with suction air, said portion extending over between 150° and 210° of said suction roller circumferential surface.

3. The suction roller of claim 1 wherein said suction roller includes at least two axially spaced apart suction rings.

4. The suction roller of claim 2 wherein said suction roller includes at least two axially spaced apart suction rings.

5. The suction roller of claim 1 wherein said sheet processing machine includes a conveying means located after, in a direction of sheet travel of said suction roller and operating at a fixed speed, and further wherein said varying circumferential speed is between zero to 1½ times said fixed speed.

* * * * *